US005711079A

United States Patent [19]

Fischer et al.

[11] Patent Number: 5,711,079

[45] Date of Patent: Jan. 27, 1998

[54] CORROSION RESISTANT KNIFE

[75] Inventors: E. Fred Fischer, San Diego; William J. Monteleone, Fallbrook, both of Calif.

[73] Assignee: Underwater Kinetics, San Marcos, Calif.

[21] Appl. No.: 730,741

[22] Filed: Oct. 15, 1996

Related U.S. Application Data

[63] Continuation of Ser. No. 445,760, May 22, 1995, abandoned.

[51] Int. Cl.[6] ..... B26B 5/00

[52] U.S. Cl. ..... 30/342

[58] Field of Search ..... 30/342, 330, 340, 30/346.54, 123; 204/196, 197, 148; 16/110 R

[56] References Cited

U.S. PATENT DOCUMENTS

| | | | |
|---|---|---|---|
| 1,420,342 | 6/1922 | Richard | 30/342 X |
| 1,777,914 | 10/1930 | Davis | 204/197 |
| 2,109,108 | 2/1938 | Fesler | 30/342 X |
| 3,421,990 | 1/1969 | Penix . | |
| 3,623,965 | 11/1971 | Owren | 204/148 |
| 3,736,243 | 5/1973 | Duggan . | |
| 3,978,309 | 8/1976 | Strobach et al. | 219/104 |
| 4,051,007 | 9/1977 | Hössle . | |
| 4,190,512 | 2/1980 | Wyatt et al. | 204/196 |
| 4,409,081 | 10/1983 | Terrase | 204/197 |
| 4,462,960 | 7/1984 | Jore . | |
| 4,470,215 | 9/1984 | Bleke . | |
| 4,520,566 | 6/1985 | Davis | 30/342 |
| 4,549,948 | 10/1985 | Peterson et al. . | |
| 4,821,356 | 4/1989 | Finn | 30/342 |
| 4,872,860 | 10/1989 | Meisenburg . | |
| 4,885,045 | 12/1989 | May . | |
| 5,155,913 | 10/1992 | Marttiini | 30/342 |
| 5,256,496 | 10/1993 | Kluczynski . | |
| 5,402,578 | 4/1995 | Whitman et al. | 30/342 X |

FOREIGN PATENT DOCUMENTS

| | | | |
|---|---|---|---|
| 3743062 | 7/1989 | Germany | 30/342 |

*Primary Examiner*—Douglas D. Watts
*Attorney, Agent, or Firm*—Brown, Martin, Haller & McClain

[57] ABSTRACT

A sacrificial anode element is connected to a knife blade to protect against galvanic corrosion. The knife also has non-metallic components that electrically insulate the metallic components of the knife from one another to further inhibit galvanic corrosion. The knife may be readily disassembled without tools. This feature enables a user to clean or dry the internal portions as well as to customize the knife by replacing its components with similar components of different materials, shapes and other useful properties. For example, a user may choose between a blade made of a metal that is exceedingly resistant to corrosion but dulls after an average period of use and a blade that is of average corrosion resistance but holds an edge exceedingly well. Other replaceable components may be selected from a group of like components of different colors. The different colors may indicate the type of metal of which the blade is made or other features of the customized knife configuration that would not be readily apparent to a user. The knife may be used in conjunction with a sheath made of a non-metallic material. The handle and sheath include features that promote the drainage of water to further inhibit corrosion.

9 Claims, 4 Drawing Sheets

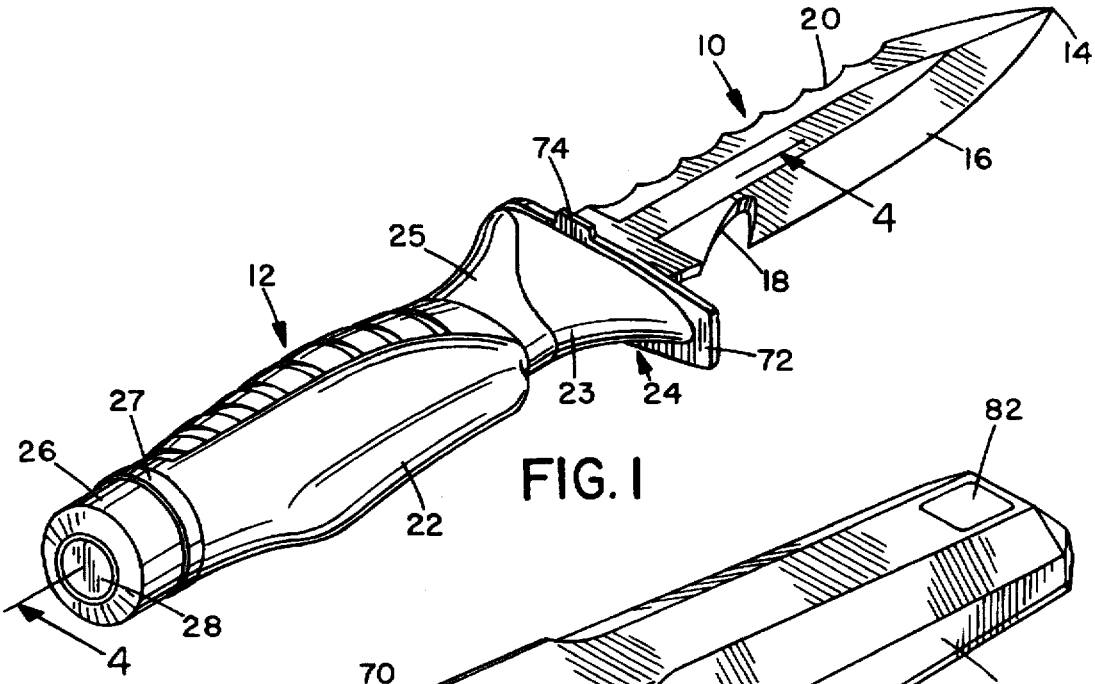
FIG. 1
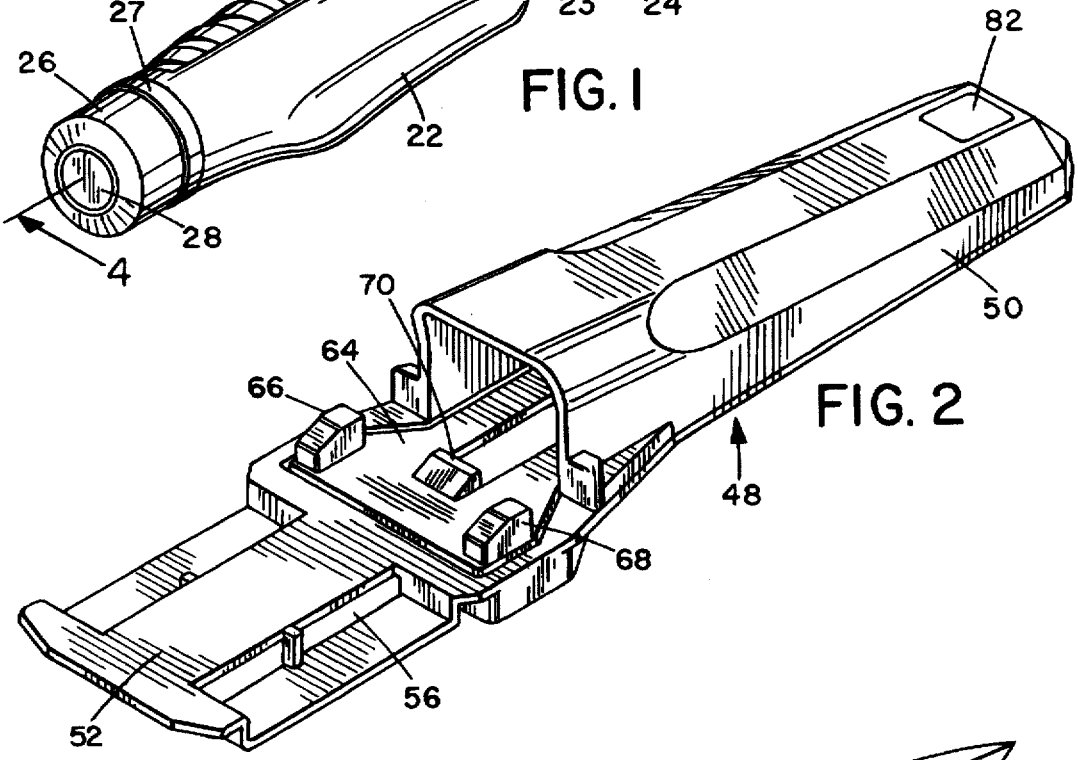
FIG. 2
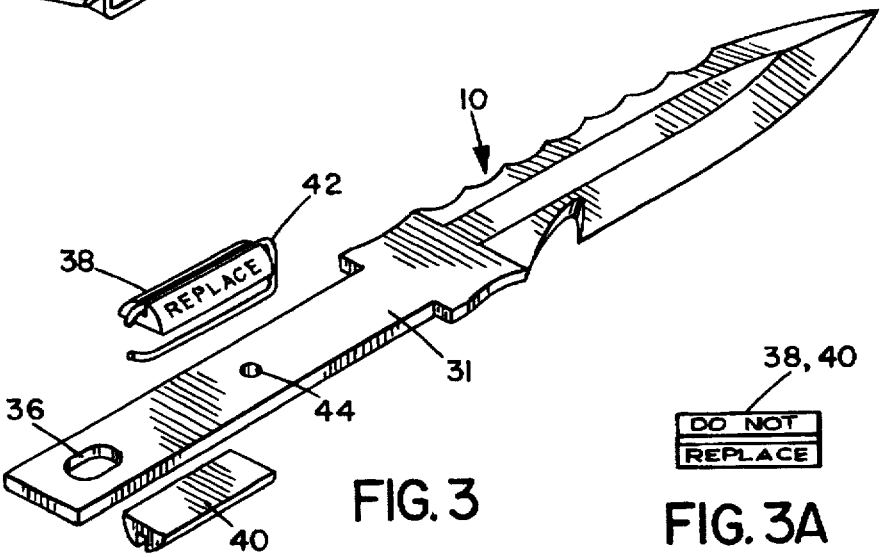
FIG. 3
FIG. 3A

CORROSION RESISTANT KNIFE

This is a continuation of application Ser. No. 08/445,760, filed May 22, 1995 now abandoned.

BACKGROUND OF THE INVENTION

A knife exposed to seawater may corrode rapidly. The blades of knives intended for use by divers may therefore be made of stainless steel, which is somewhat resistant to corrosion. The grips of such knives may be made of rubber or plastic, which do not corrode. Nevertheless, other components of such knives, such as the pommel or the guard, may be made of metal. The metal-to-metal connection between, for example, the pommel and the knife blade promotes galvanic corrosion. Galvanic corrosion occurs as a result of current generated by the electrochemical reaction between dissimilar metals in the presence of an electrolyte. Even if the two components, such as the blade and the pommel, are nominally made of the same type of metal, the presence of impurities in one component with respect to the other will cause galvanic corrosion. Softer types of stainless steel, such as Type 316, are more corrosion resistant than harder types, such as Type 420, but do not hold an edge as well. Although corrosion in a knife made of soft stainless steel may manifest itself as no more than unsightly discolorations, susceptibility to such discoloration detracts considerably from the marketability of knives. Knives made of harder stainless steel have generally been considered unsuitable for use in diving knives because they corrode rapidly.

It is known that metallic members can be protected from galvanic corrosion by providing the members with an anodic material that corrodes preferentially with respect to the member metal, thereby sacrificially corroding the anodic material and preserving the metallic member. This technique is commonly known as "anodic protection" or "cathodic protection." For example, practitioners in the art have protected metallic members by applying a primer coating containing zinc to members made of steel. Ships have long been protected by attaching plates made of zinc to the hull. U.S. Pat. No. 3,736,243, issued to Duggan, discloses cathodic protection for a razor blade by applying an electric potential to it.

Resistance to dulling and resistance to corrosion are desirable properties in a knife. Nevertheless, the higher hardness stainless steels that hold an edge well are more susceptible to corrosion than the softer types of stainless steel. It would be desirable to provide a knife that is both highly resistant to corrosion and that holds an edge well. These problems and deficiencies are clearly felt in the art and are solved by the present invention in the manner described below.

SUMMARY OF THE INVENTION

The present invention is a knife suitable for use in corrosive environments. The present invention may also include a sheath.

In accordance with one aspect of the invention, the knife comprises a sacrificial anode element electrically connected to the blade. In accordance with another aspect of the invention, the knife comprises components made of suitable non-metallic materials, such as plastic, that electrically insulate the metallic components of the knife from one another. The sheath is made of a suitable non-metallic material. Non-metallic elements of the knife, such as portions of the handle, may include internal grooves or ridges connected to openings for promoting drainage of water and circulation of air between those elements and the metallic elements that they contact. Other non-metallic elements of the knife, such as portions of the sheath, may include grooves or ridges connected to openings that promote the drainage of water and circulation of air between those elements and the metallic elements that they contact. These anti-corrosion features allow the blade to be made of high-carbon steel or other metals that are highly suitable for knives but were believed in the prior art to be too susceptible to corrosion for knives intended for use in corrosive environments.

The knife may be readily disassembled without tools. The ability to disassemble the knife, enables a user to clean or dry the internal portions. The ability to disassemble the knife also enables a user to customize the knife by replacing its components, as described below.

In accordance with another aspect of the invention, the knife may include components that can be removed and replaced with similar components made of different materials, or having different shapes or other useful properties. Because the knife can readily be disassembled without tools, it may be desirable to select a blade made, for example, of either Type 316 stainless steel or Type 420 stainless steel; Type 316 is more resistant to corrosion, but dulls more rapidly than Type 420. The interchangeable components allow a user to customize the knife to suit his or her requirements.

Certain interchangeable components of the knife may have color indicia that can serve a variety of useful purposes. For example, the colors may indicate the type of metal of which the blade is made. Alternatively, for example, the colors may be associated with members of a group of individuals who dive together. The colored components to install in the knife may be selected from a group of like components having different colors.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein:

FIG. 1 is a perspective view of the knife;

FIG. 2 is a perspective view of the sheath;

FIG. 3 is a perspective view of the knife blade, with the anodes detached;

FIG. 3A is a top plan view of an anode;

DESCRIPTION OF A PREFERRED EMBODIMENT

Figure 5:
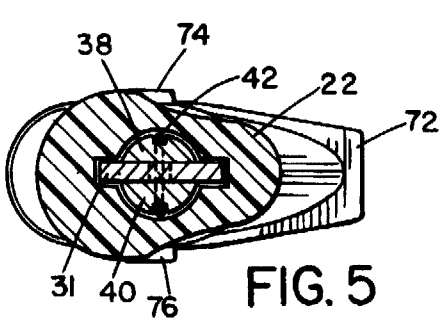
FIG. 5 is a sectional view taken on line 5—5 of FIG. 4.

As illustrated in FIG. 1, the knife of the present invention has a blade 10 and a handle 12. As described below, blade 10 is highly resistant to corrosion. The knife is thus particularly well-suited for use by divers and others in a saltwater environment.

Blade 10 may have any suitable shape and configuration of features. The illustrated blade configuration includes a symmetric or bayonet-style point 14, a sharp edge 16, a hooked edge 18 for cutting line, and a serrated edge 20 for cutting rope and line. Nevertheless, suitable alternative features include a chisel-shaped tip, an offset or "drop" point, and any other features commonly used in diving knives. Blade 10 is made of either stainless steel, preferably either Type 316 or Type 420. Type 316 is more resistant to corrosion and more flexible but dulls somewhat more rapidly than Type 420. A diver may thus, for example, prefer Type 316 for digging and prying and Type 420 for spearing or filleting fish. As described below, the present invention facilitates replacement of blade 10 with a blade 10 having a different shape or configuration of features or made of a different type of stainless steel. A diver having an assortment of different replacement blades may quickly and easily configure the knife to suit the expected requirements of a particular dive or other activity.

Handle 12 comprises a grip 22 and an enlarged guard 24. Grip 22 is made of non-metallic, semi-elastomeric material, such as thermoplastic elastomer-filled polypropylene, to provide both durability and a frictional surface for a user to grasp. Guard 24 is also made of a non-metallic material. Guard 24 comprises two portions 23 and 25 that are removably connected to each other, as described below. Guard portion 23 is preferably made of glass-filled nylon (polyamide) to provide durability. Guard portion 25 is preferably made of a thermoplastic elastomer to provide resiliency, as described below.

Figure 4:
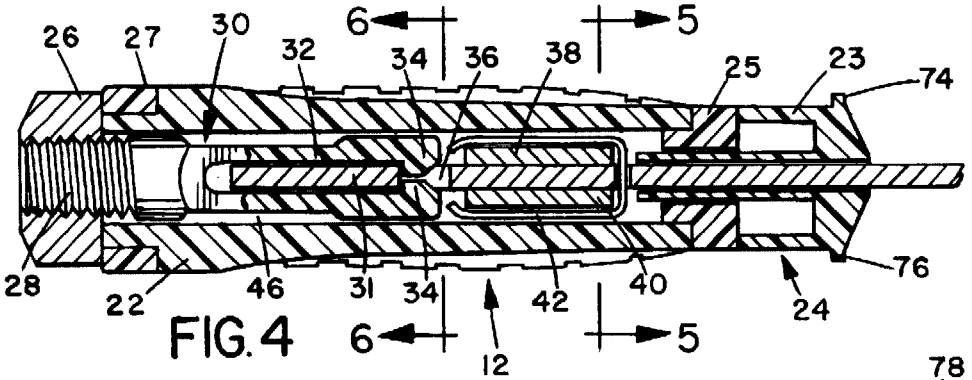
FIG. 4 is an enlarged sectional view taken on line 4—4 of FIG. 1.
Figure 11:
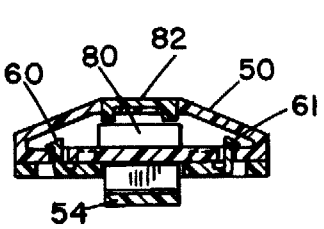
FIG. 11 is a sectional view taken on line 11—11 of FIG. 8.
Figure 10:
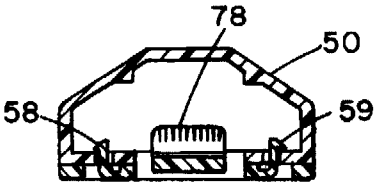
FIG. 10 is a sectional view taken on line 10—10 of FIG. 8.
Figure 6:
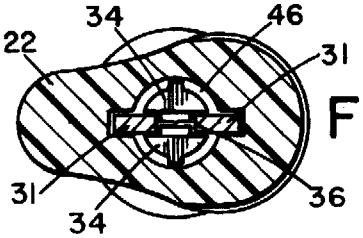
FIG. 6 is a sectional view taken on line 6—6 of FIG. 4.

The knife also has a pommel 26 made of stainless steel and a pommel ring 27 made of a non-metallic material such as a thermoplastic elastomer. Pommel 26 has an annular shape with a threaded opening. As best shown in FIG. 4, pommel 26 is removably attachable to the threaded extension 28 on one end of an elongated retainer 30. The tang 31 of blade 10 is removably attachable to a split or U-shaped extension 32 on the opposite end of retainer 30. U-shaped extension 32 comprises two fingers 34 that engage opposite sides of an elongated opening 36 in blade 10. Fingers 34 secure blade 10 within U-shaped extension 32 in a clevis-like arrangement. Retainer 30 is made of a durable non-metallic material, such as glass-filled nylon. Retainer 30 has sufficient resiliency to allow a person to spread fingers 34 slightly to attach or remove it from tang 31.

Retainer 30 inhibits galvanic corrosion by electrically insulating blade 10 from pommel 26. Even if blade 10 and pommel 26 are nominally made of the same type of stainless steel, the presence of impurities in one component with respect to the other would cause galvanic corrosion if an electrically conductive connection were to exist between them.

As best illustrated in FIGS. 3–4, two semicylindrical sacrificial anodes 38 and 40 in handle 12 further inhibit corrosion of blade 10. Anodes 38 and 40 are preferably made of zinc or lead, which metals corrode preferentially with respect to the stainless steel of blade 10. Blade 10 will not begin to corrode until anodes 38 and 40 have been completely consumed. A U-shaped metal clip 42 extends through an opening 44 in tang 31 and engages slots in anodes 38 and 40 to retain anodes 38 and 40. The resiliency of clip 42 presses anodes 38 and 40 against tang 31 and thus maintains them in electrical contact with tang 31 after anodes 38 and 40 have begun to corrode. As illustrated in FIG. 3A, each of anodes 38 and 40 is inscribed with the notation "DO NOT REPLACE." The words "DO NOT" are inscribed to a depth in the metal of anodes 38 and 40 that is less than the depth to which the word "REPLACE" is inscribed. As the metal corrodes from the surface of anodes 38 and 40, the words "DO NOT" will thus become illegible and eventually obliterated before the word "REPLACE." A user will thus observe the notation "REPLACE" when the anodes have become sufficiently corroded to warrant their replacement with new anodes. A user can readily disassemble the knife to remove anodes 38 and 40 and replace them. The words "DO NOT" are preferably inscribed to a depth of 0.020 inches, and the words "REPLACE" are preferably inscribed to a depth of 0.050 inches.

To disassemble the knife, the user unscrews pommel 26 from threaded extension 28 and removes pommel ring 27. The user then slides grip 22, which has an internal channel 46 that receives tang 31, off of tang 31. The user can then slide guard 24 off of tang 31 in a similar manner. With the knife disassembled in this manner, the user can replace anodes 38 and 40 or can use the components removed from blade 10 to assemble a knife around a different blade (not shown) having a different configuration or made of a different type of stainless steel.

Sufficient space or channels exist in internal channel 46 to allow water to drain from the interior of handle 12. However microscopic the passage, the water will eventually drain between the threads of pommel 26 and extension 28.

In addition to locking the components of the knife together in the manner described above, pommel 26 provides a hard surface on which a user can carefully pound with a hammer or similar tool, to use the knife in a chisel-like manner. Nevertheless, the shock transmitted to blade 10 by excessive pounding could damage it. Pommel ring 27, guard portion 25, and, to a certain extent, grip 22, which are all at least slightly elastomeric, absorb excessive shock experienced by pommel 26. The elongated shape of slot 36 allows retainer 30 to move slightly with respect to blade 10 in response to the compression of pommel ring 27, guard portion 25, and grip 22. The elastomeric components also promote retention of pommel 26 when pommel 26 is threaded onto extension 28 to a degree sufficient to compress one or more of these components.

Because the interchangeable components of the knife allow a user to readily configure a knife to suit his or her individual requirements, a variety of useful purposes may be served by providing a selection of the nonmetallic components of the knife in different colors. Guard portion 25 or pommel ring 27 or both are preferably of a different color than the remaining non-metallic components of the knife. For example, grip 22 and guard portion 24 may be black, and guard portion 24 and pommel ring 27 may be green, blue or some other color that is easily distinguished from black. As described above, each of these components is readily interchangeable and replaceable and thus may be replaced with a similar component of a different selected color. Color may serve to differentiate the knife possessed by a particular individual from the knives of other individuals with whom he or she is diving. Alternatively, color may serve to indicate the metal type of blade 10. For example, a green pommel ring 27 may indicate that the blade is made of Type 420 stainless steel, and a blue pommel ring 27 may indicate that the blade is made of Type 316 stainless steel. As the term is used herein, differences in "color" include differences in hues and values, including black and white, differences in opacities, and differences in any other properties that provide a visually distinguishable contrast.

Figure 7:
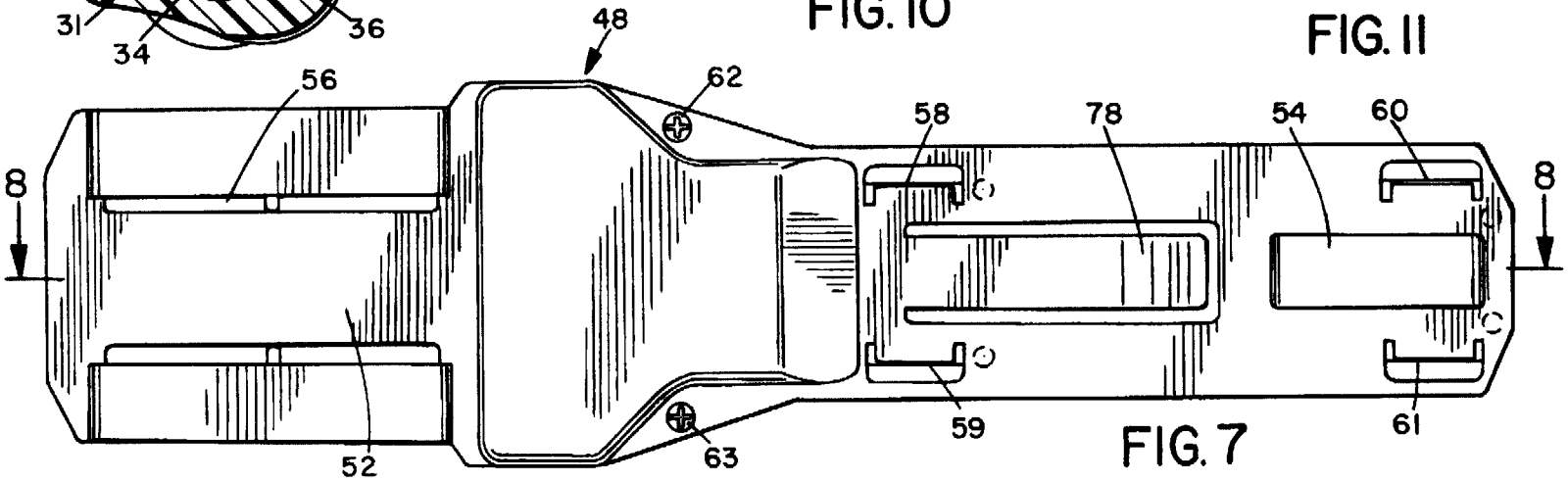
FIG. 7 is a bottom plan view of the sheath.
Figure 8:
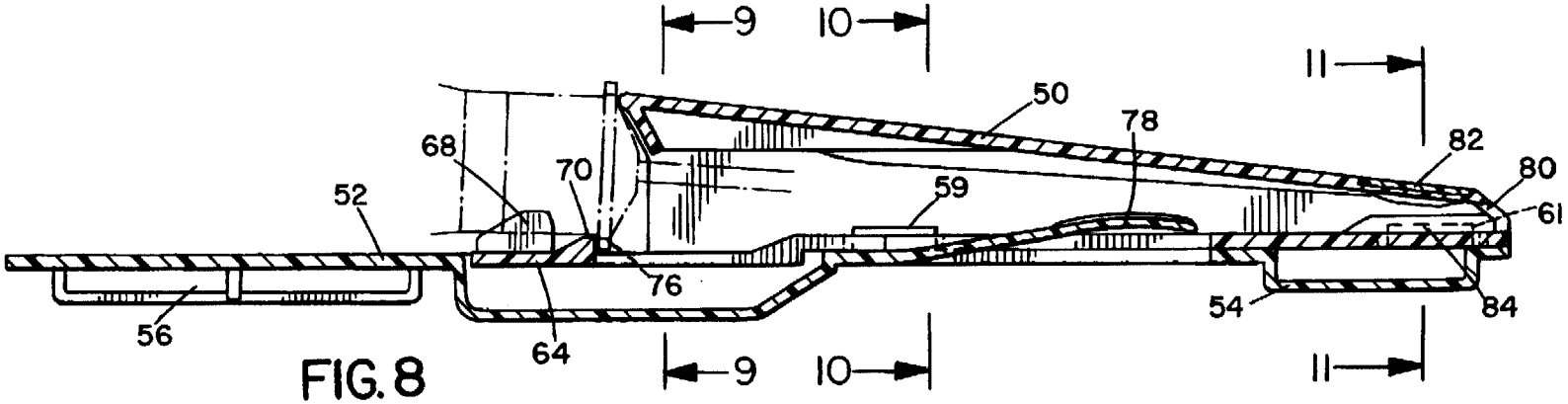
FIG. 8 is a sectional view taken on line 8—8 of FIG. 7.
Figure 9:
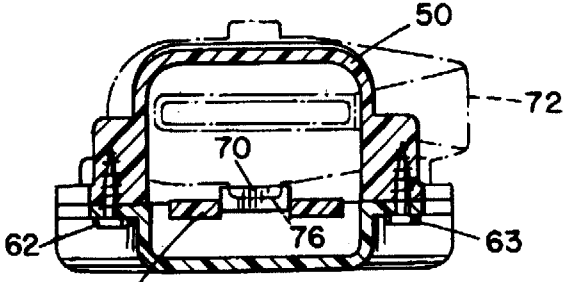
FIG. 9 is a sectional view taken on line 9—9 of FIG. 8.

As shown in FIGS. 2 and 7–11, the knife may be stored in a sheath 48 having a cover portion 50 for enclosing the sharp end of blade 10 and a base portion 52. As best shown in FIG. 7, base portion 52 has openings 54 and 56 for receiving straps (not shown) that a diver may use to attach the sheath to himself. Base portion 52 has tabs 58, 59, 60 and 61 that snap into corresponding slots in cover portion 50. Two stainless steel screws 62 and 63 further secure base portion 52 cover portion 50. Base portion 52 and cover portion 50 are both made of a durable, non-metallic material, such as ABS plastic.

Figure 12:
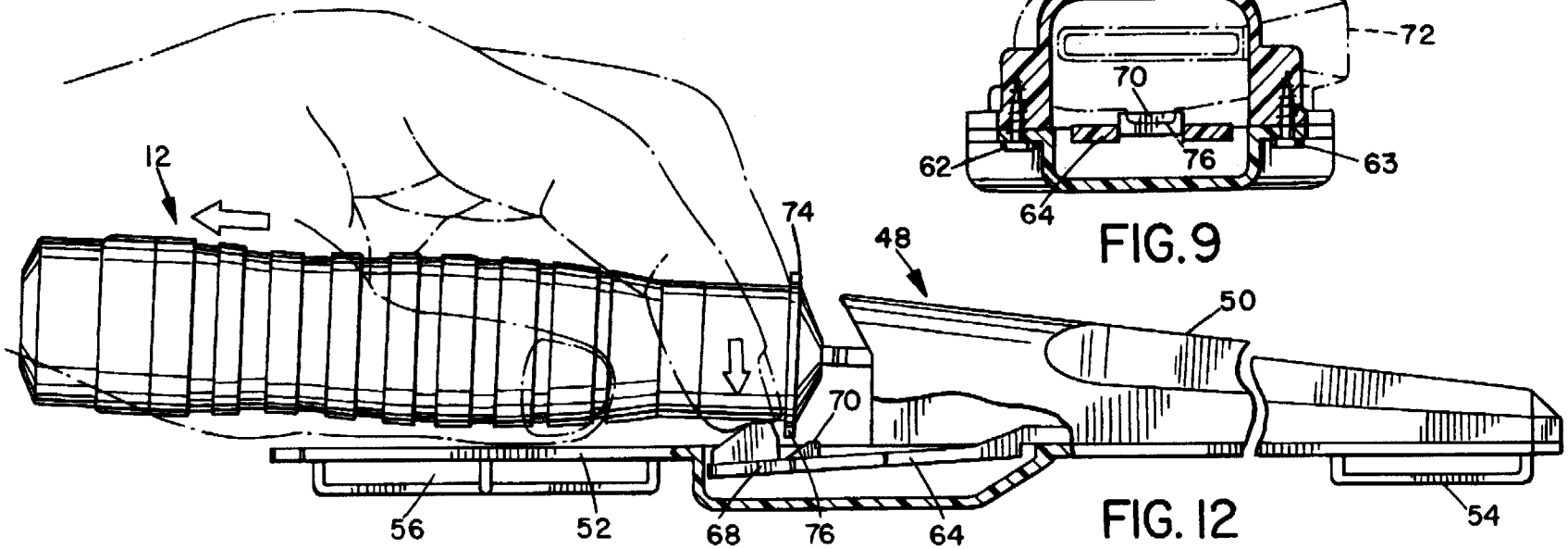
FIG. 12 is a side elevation view showing the method for releasing and withdrawing the knife from the sheath.

Cover portion 50 has a locking leaf spring 64 integrally formed in it. Leaf spring 64 has two actuator tabs 66 and 68 and a locking tab 70. As shown in FIG. 12, a user may remove the knife from sheath 48 by depressing actuator tabs 66 and 68, thereby flexing locking leaf spring 64 away from the knife and disengaging locking tab 70 from the flat portion 72 (FIG. 1) of guard 24. Flat portion 72 has two extensions 74 and 76 (see also FIG. 1) that maximize the area for engaging locking tab 70. To sheath the knife, the user simply inserts blade 10 into sheath 48 until locking tab 70 snaps into engagement with flat portion 72. The user need no be concerned with the orientation in which the knife is inserted into sheath 48; the knife can be sheathed and locked in place in either of the two possible orientations because the portions of flat portion 72 that engage locking tab 70 are identical on each side of the knife.

Sheath 48 includes features that further inhibit corrosion by promoting the drainage of water and circulation of air. When knife blade 10 is sheathed, it preferably is spaced from the inside walls of sheath 48 to maximize exposure of its surfaces to the air and thereby promote drying. Base portion 52 has a tensioning leaf spring 78 integrally formed in it. When knife blade 10 is inserted into sheath 48, knife blade 10 compresses leaf spring 78. Leaf spring 78 thus not only prevents knife blade 10 from moving or rattling in sheath 48, but also centers knife blade 10 in sheath 48 to space it from the inside walls. The surface of leaf spring 78 that contacts knife blade 10 has grooves or striations that inhibit the collection of water between knife blade 10 and leaf spring 78. An opening 80 in the extreme distal end of sheath 48 promotes the drainage of water from sheath 48. A bumper 82, preferably made of a thermoplastic elastomer, and two rails 84 and 86 at the distal end of sheath 48 also space knife blade 10 from the inside walls of sheath 48.

Figure 13:
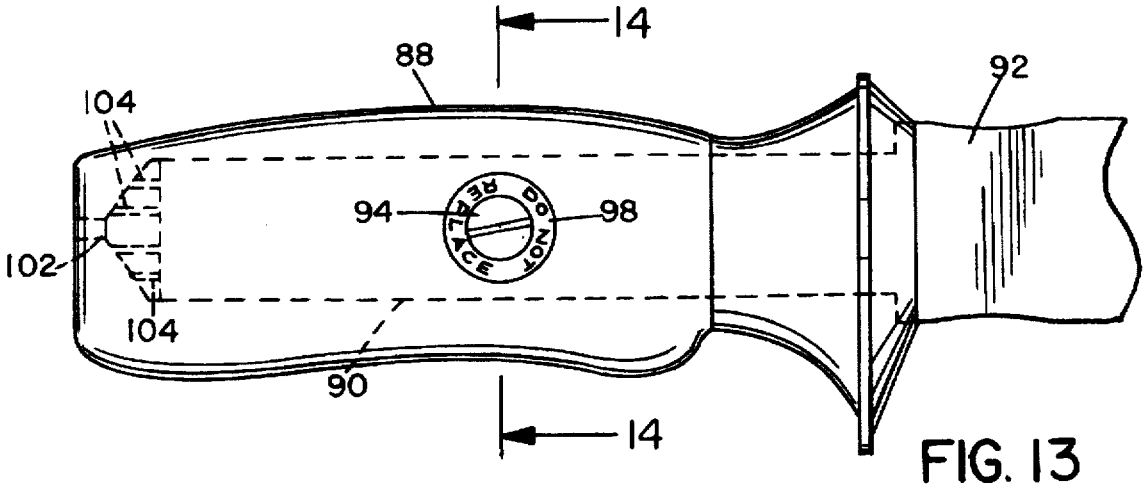
FIG. 13 is a side elevation view of an alternative embodiment of the knife.
Figure 14:
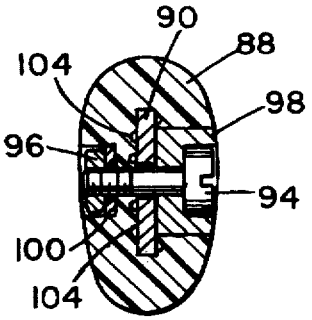
FIG. 14 is a a sectional view taken on line 14—14 of FIG. 13.

As illustrated in FIGS. 13 and 14, in an alternative embodiment, the knife comprises a handle 88 having a longitudinal opening that receives the tang 90 of a blade 92. A bolt 94, which is preferably made of a stainless steel, extends through an opening in handle 88 and an opening in tang 90 and is secured by a threaded nut 96. Bolt 94 also extends through an annular anode 98, which is made of a material that corrode preferentially with respect to the material of blade 92. A resilient washer 100, such as a split washer, a wave washer ro a Belleville washer, maintains anode 98 securely in electrical contact with tang 90, thereby providing anodic protection against corrosion of blade 92. Anode 98 has inscribed indicia for indicating the extent to which it has corroded. As described above with respect to another embodiment, the indicia comprise the words "DO NOT REPLACE," where the words "DO NOT" are inscribed to a depth of 0.020 inches, and the word "REPLACE" is inscribed to a depth of 0.050 inches.

The proximal end of handle 88 has an opening 102. The interior walls of the longitudinal opening of handle 88 have grooves or striations 104 extending along their lengths for promoting the drainage of water through opening 102.

Figure 15:
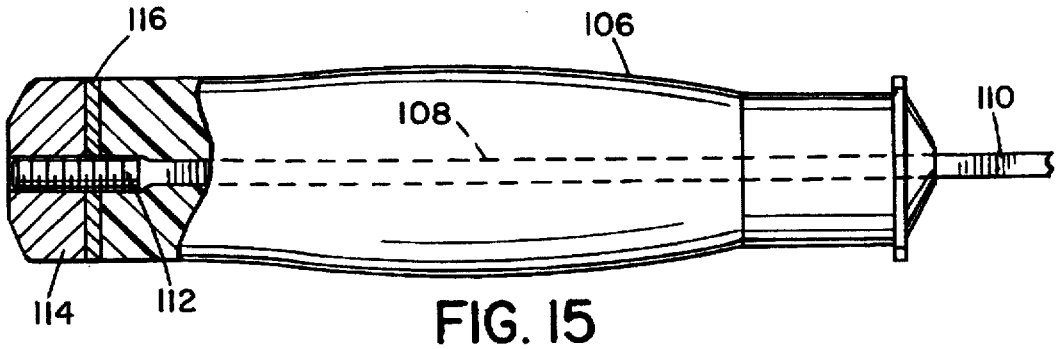
FIG. 15 is a side elevation view with a partial section cut away, of another alternative embodiment of the knife.

As illustrated in FIG. 15, in another alternative embodiment, the knife comprises a handle 106 having a longitudinal opening that receives the tang 108 of a blade 110 in a manner similar to that described above with respect to the embodiment illustrated in FIGS. 13 and 14. The proximal end of tang 108 has a threaded extension 112 on which an annular pommel 114 is mounted. A spacer, such as a washer or annular disc 116 is disposed between pommel 114 and the proximal end of handle 106. Disc 116 may be made of a material that corrodes preferentially with respect to the material of blade 110, thereby providing anodic protection against corrosion of blade 110. Disc 116 may have inscribed indicia (not shown) for indicating the extent to which it has corroded, as described above with respect to other embodiments. Alternatively, or in addition, disc 116 may be made of stainless steel, and pommel 114 may be made of a material that corrodes preferentially with respect to blade 110. Pommel 114 may have inscribed indicia (not shown) for indicating the extent to which it has corroded, as described above.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A knife, comprising:

an elongated handle made of a non-conductive material and having a longitudinal opening therethrough;

a metallic pommel;

an elongated metallic blade having a tang extending freely into said longitudinal opening in said handle; and a connecting member made of a non-conductive material and having a distal end coupled to said tang of said metal blade and a proximal end coupled to said pommel.

2. The knife claimed in claim 1, wherein said pommel is removably coupled to said proximal end of said connecting member.

3. The knife claimed in claim 2, wherein said pommel has a threaded opening, and said proximal end of said connecting member is threadably engaged in said opening.

4. The knife claimed in claim 1, further comprising at least one resilient member between said pommel and said blade for resiliently absorbing a compressive shock force applied between said blade and said pommel.

5. The knife claimed in claim 1, wherein said handle is made of a resilient material for absorbing a compressive shock force applied between said blade and said pommel.

6. The knife claimed in claim 1, wherein said tang has an elongated opening, and said distal end of said connecting member slidably engages said elongated opening.

7. The knife claimed in claim 1, wherein said connecting member comprises a rod having a U-shaped extension with fingers at said distal end for engaging said elongated opening.

8. The knife claimed in claim 7, wherein said fingers of said U-shaped extension are resiliently spreadable to disengage said fingers from said elongated opening.

9. The knife claimed in claim 1, further comprising a sacrificial anode conductively coupled to said blade and made of a material that corrodes preferentially with respect to a material of said blade.

* * * * *